US006790052B2

(12) United States Patent
Schmidgall et al.

(10) Patent No.: US 6,790,052 B2
(45) **Date of Patent: *Sep. 14, 2004**

(54) CIRCUIT BOARD STRADDLE MOUNTED CONNECTOR

(75) Inventors: David R. Schmidgall, Wood Dale, IL (US); Richard A. Nelson, Geneva, IL (US)

(73) Assignee: Molex Incorporated, Lisle, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/503,028

(22) Filed: Feb. 14, 2000

(65) Prior Publication Data

US 2002/0034894 A1 Mar. 21, 2002

(51) Int. Cl.[7] ..... H01R 12/00

(52) U.S. Cl. ..... 439/79; 439/95; 439/101; 439/108; 439/607

(58) Field of Search ..... 439/79, 95, 328, 439/59, 64, 607, 101, 108, 629, 630, 637

(56) References Cited

U.S. PATENT DOCUMENTS

| | | | | |
|---|---|---|---|---|
| 4,553,804 A | * | 11/1985 | Lapraik et al. | 339/74 |
| 4,938,704 A | | 7/1990 | Fujiura | 439/95 |
| 4,943,244 A | | 7/1990 | Teck et al. | 439/567 |
| 4,986,779 A | | 1/1991 | Ferrill et al. | 439/108 |
| 5,160,275 A | | 11/1992 | Nakamura et al. | 439/328 |
| 5,178,562 A | | 1/1993 | Ermini | 439/609 |
| 5,207,597 A | | 5/1993 | Kline et al. | 439/607 |
| 5,238,413 A | | 8/1993 | McCaffrey et al. | 439/79 |
| 5,387,114 A | | 2/1995 | Brunker et al. | 439/108 |
| 5,401,192 A | | 3/1995 | Briones et al. | 439/639 |
| 5,522,737 A | * | 6/1996 | Brunker et al. | 439/637 |
| 5,540,598 A | | 7/1996 | Davis | 439/79 |
| 5,562,496 A | | 10/1996 | Benjamin et al. | 439/607 |
| 5,702,271 A | | 12/1997 | Steinman | 439/676 |
| 5,752,854 A | | 5/1998 | Capp et al. | 439/607 |
| 5,755,586 A | * | 5/1998 | Knighton et al. | 439/328 |
| 5,755,592 A | | 5/1998 | Hillbish et al. | 439/541.5 |
| 5,766,043 A | | 6/1998 | Talend | 439/676 |
| 5,772,453 A | | 6/1998 | Tan et al. | 439/79 |
| 5,823,799 A | | 10/1998 | Tor et al. | 439/79 |
| 5,865,646 A | | 2/1999 | Ortega et al. | 439/607 |
| 5,881,454 A | | 3/1999 | Baxter et al. | 29/843 |
| 5,897,386 A | | 4/1999 | Baxter et al. | 439/79 |
| 5,947,769 A | | 9/1999 | Leonard et al. | 439/607 |
| 5,971,775 A | | 10/1999 | Tor et al. | 439/79 |

FOREIGN PATENT DOCUMENTS

| | | |
|---|---|---|
| GB | 2 261 559 A | 5/1993 |
| JP | 63-6680 | 1/1988 |
| JP | 3-79179 | 8/1991 |
| JP | 4-51781 | 4/1992 |
| JP | 4-322088 | 11/1992 |
| JP | 5-315032 | 11/1993 |
| JP | 7-153507 | 6/1995 |

* cited by examiner

*Primary Examiner*—Tho D. Ta
*Assistant Examiner*—Truc Nguyen
(74) *Attorney, Agent, or Firm*—Robert J. Zeitler

(57) ABSTRACT

An electrical connector is provided for straddle mounting at an edge of a circuit board. The connector includes a dielectric housing defining a slot for receiving the edge of the board. A plurality of terminals are mounted on the housing and include contact portions for connection to the circuit traces on the board. A flexible gripping arm is integral with the housing at one side of the slot for yieldably engaging the circuit board upon insertion of the board into the slot. A ground tab extends from a shielding plate on the mating face of the connector through the housing adjacent to the slot for contacting a ground pad on the circuit board.

7 Claims, 4 Drawing Sheets

CIRCUIT BOARD STRADDLE MOUNTED CONNECTOR

FIELD OF THE INVENTION

This invention generally relates to the art of electrical connectors and, particularly, to a connector for straddle mounting at an edge of a circuit board having circuit traces on at least one side of the board near the edge.

BACKGROUND OF THE INVENTION

Electrical connectors often are mounted to circuit boards, with the contact portions of a plurality of terminals mounted on the connector housing connected, as by soldering, to circuit traces on the surface of the circuit board. Most often, the connectors are mounted flush to the surface of the board or near the edge of the board where a portion of the connector housing might overlap the board edge. With these surface-mounted connectors, the connector housing typically is mounted to the circuit board by mounting posts inserted into mounting holes in the board in a direction generally perpendicular to the board. The mounting posts do not necessarily permanently fix the connector the board, but the posts precisely locate the connector and temporarily hold the connector during the soldering process which permanently fixes the connector terminals to the circuit traces of the board. With surface-mounted connectors, the connector also may include a shield having grounding tabs soldered to ground pads on the surface of the circuit board.

In some instances, design specifications require an electrical connector to be "straddle" mounted to the edge of the circuit board. Such connectors often are used where it is desirable to have the terminals of the connector connected, as by soldering, to circuit traces on both opposite sides of the board. When a connector is straddle mounted to a circuit board, an edge of the board typically is inserted into a slot of the connector in a direction generally parallel to the board. Therefore, mounting posts used with surface mounted connectors cannot be inserted into holes in the board with straddle mounted connectors. Consequently, somewhat elaborate mounting schemes have been used to mount a straddle mounted connector to the board during soldering of the terminals to the circuit traces on the board. Such schemes often create design problems because they require valuable "real estate" on the board which otherwise could be used for routing circuit traces on the board. With the ever-increasing miniaturization of circuit board electronics, this problem is magnified with high density connectors and circuit board circuitry. The present invention is directed to solving these problems by providing novel features which facilitate straddle mounting an electrical connector to a circuit board.

SUMMARY OF THE INVENTION

An object, therefore, of the invention is to provide a new and improved electrical connector for straddle mounting at an edge of a circuit board having circuit traces on at least one side of the board near the edge.

In the exemplary embodiment of the invention, the connector includes a dielectric housing defining a slot for receiving the edge of the circuit board. A plurality of terminals are mounted on the housing and include contact portions for connection to the circuit traces on the circuit board, as by soldering. A flexible gripping arm is integral with the housing at one side of the slot for yieldably engaging the circuit board upon insertion of the board into the slot.

As disclosed herein, the housing is molded of plastic material, and the flexible gripping arm is molded integrally therewith. The contact portions of the terminals connect to circuit traces on both opposite sides of the circuit board. The housing defines a fixed datum plane at one side of the slot for locating the circuit board. The flexible gripping arm is disposed at the opposite side of the slot for biasing the circuit board against the datum plane. The housing is elongated, with the terminals mounted on the housing spaced from opposite ends thereof. The slots are provided with at least one of the gripping arms near each opposite end of the housing outside the terminals.

Another feature of the invention involves the provision of EMI tabs on a shield of the connector. Specifically, the slot, the flexible gripping arm and the contact portions of the terminals are located at a rear terminating face of the housing. A shielding plate is juxtaposed against a front mating face of the housing. The shielding plate includes a plurality of integral, resilient EMI tabs projecting forwardly thereof for biasingly engaging a mounting panel to which the connector can be mounted. The shielding plate is stamped and formed of sheet metal material, and the EMI tabs are bent forwardly thereof.

Another feature of the invention involves a shield over at least a portion of the housing, with the shield including a generally planar ground tab for connection to a grounding pad on the circuit board. The ground tab includes a small bump for sliding over the grounding pad when the circuit board is inserted into the slot. The bump prevents the remainder of the ground tab from wiping solder paste off of the grounding pad on the circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
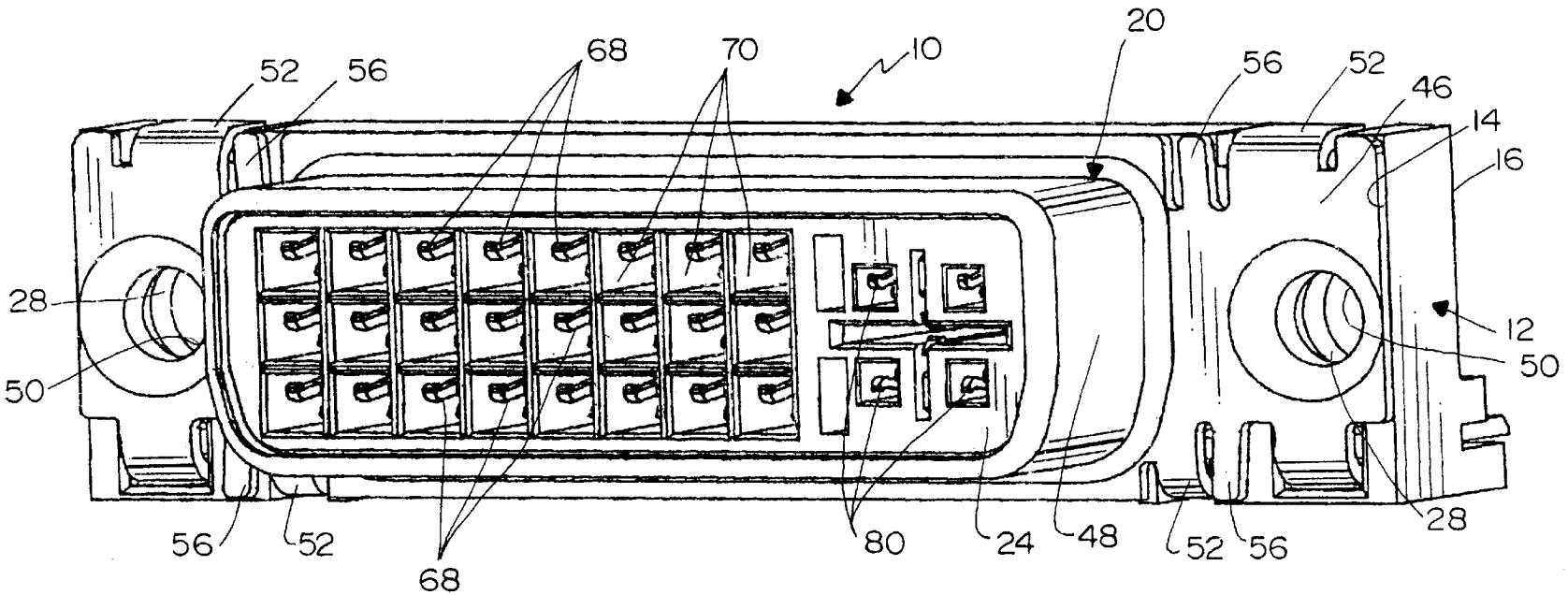
FIG. 1 is a front perspective view of an electrical connector embodying the concepts of the invention.
Figure 2:
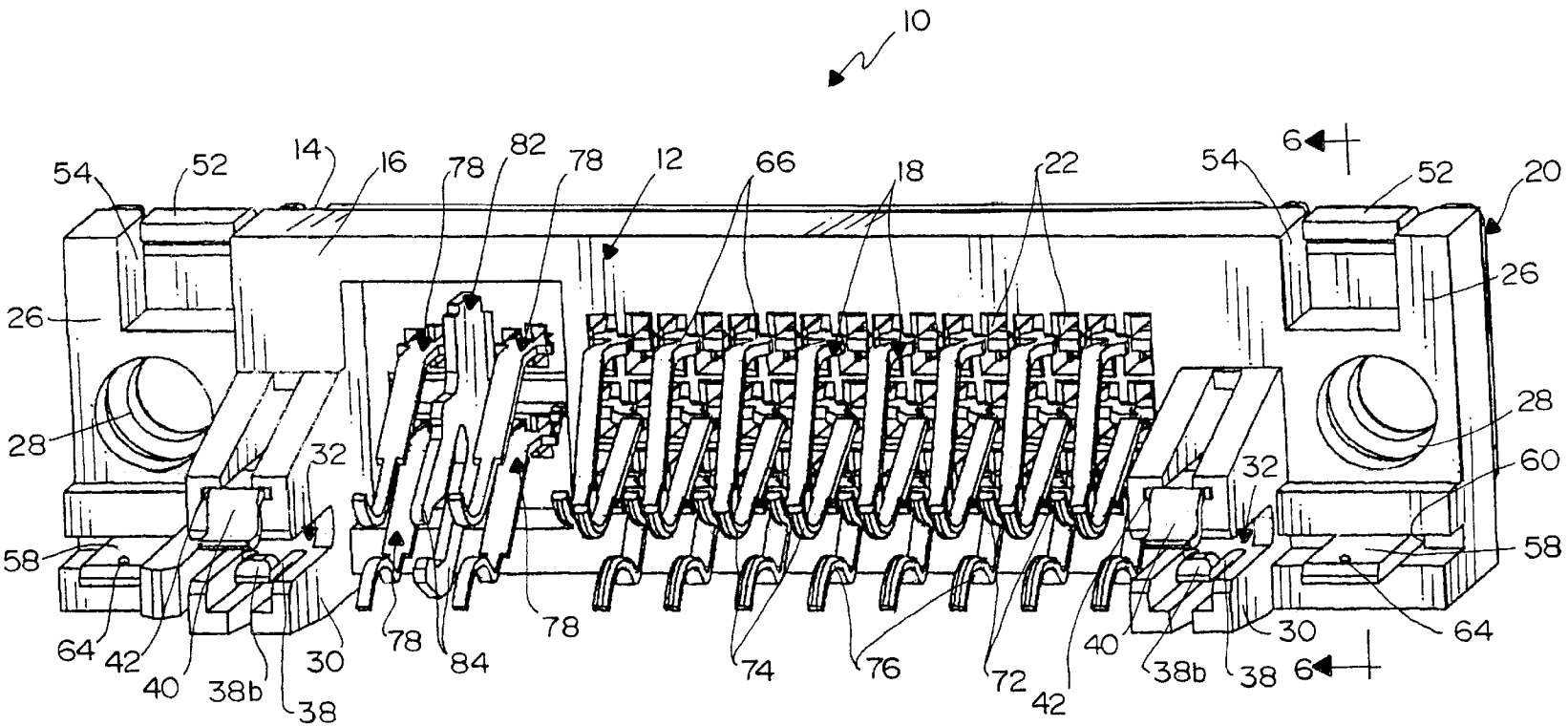
FIG. 2 is a rear perspective view of the connector.

Referring to the drawings in greater detail, and first to FIGS. 1 and 2, the invention is incorporated in an electrical connector, generally designated 10, for straddle mounting at an edge of a circuit board (not shown) having circuit traces on at least one side of the board near the edge as is known in the art. Connector 10 includes a dielectric housing, generally designated 12, which defines a front mating face 14 and a rear terminating face 16. A plurality of terminals, generally designated 18, are mounted in the housing. A shield, generally designated 20, is mounted over the housing, primarily over the front of the housing as will be described in greater detail hereinafter.

Housing 12 of connector 10 is elongated and includes a plurality of generally centrally located terminal-receiving passages 22 (FIG. 2) which extend between front mating face 14 and rear terminating face 16 of the housing for receiving terminals 18 in at least three rows thereof. The housing is a one-piece structure molded of dielectric material such as plastic or the like. The housing has an elongated, generally rectangular mating portion 24 (FIG. 1) and opposite ends 26 (FIG. 2) which extend longitudinally beyond mating portion 24. Mating portion 24 may extend through a rectangular opening in a mounting panel or backplane (not shown) and a pair of mounting holes 28 are formed through ends 26 for receiving appropriate fasteners to fix the connector to the panel.

Figure 3:
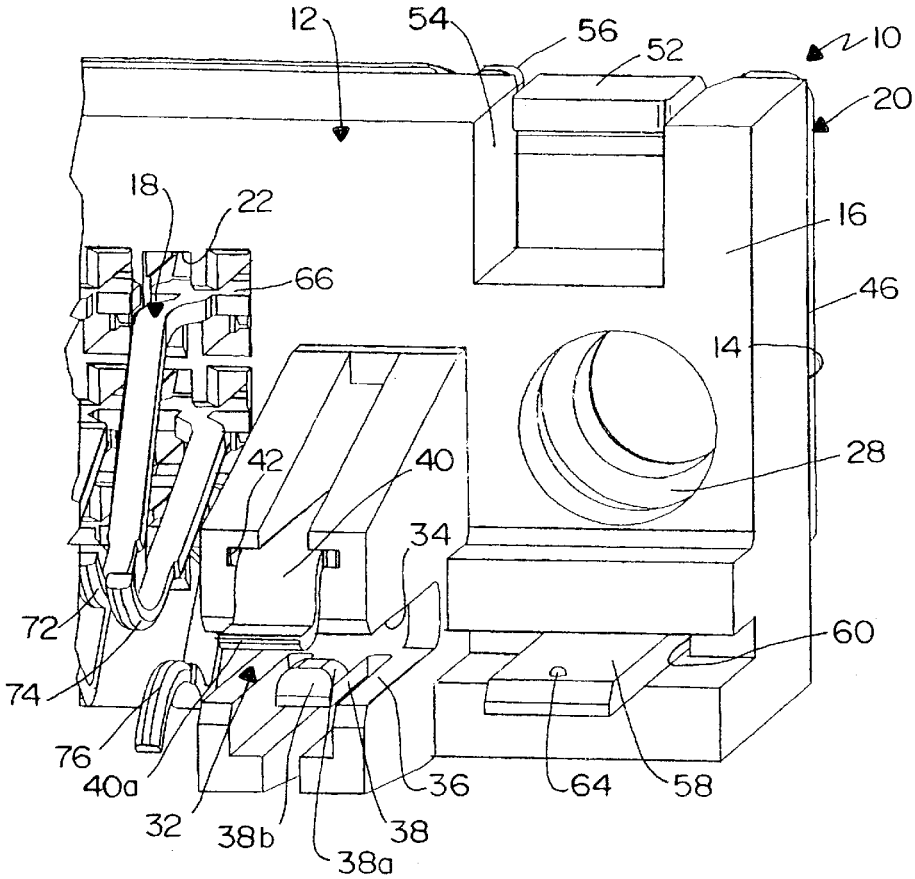
FIG. 3 is an enlarged perspective view of one end of the connector at the rear thereof to better show one of the gripping arms.
Figure 4:
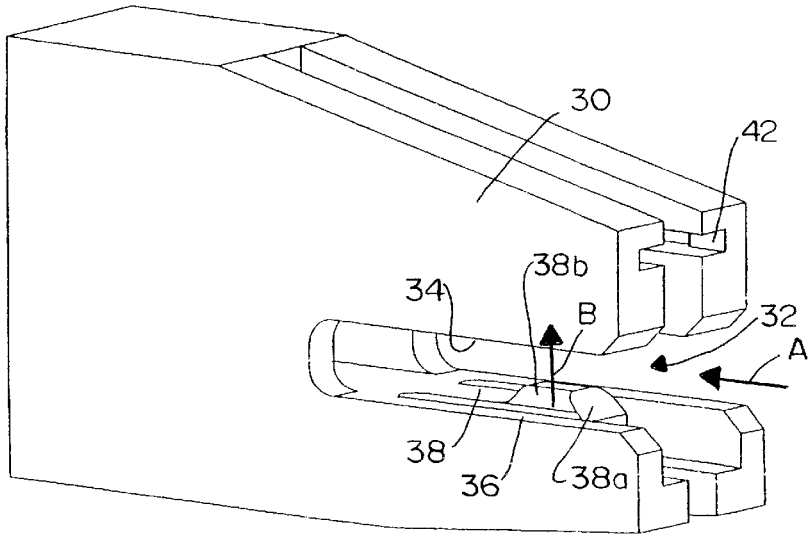
FIG. 4 is a further enlarged perspective view of one of the bifurcated mounting posts showing the slot therein and one of the gripping arms.

Referring to FIGS. 3 and 4 in conjunction with FIG. 2, housing 12 includes a pair of integrally molded, bifurcated mounting posts 30 which define a slot for receiving the edge of the circuit board. Specifically, each bifurcated mounting post 30 has a slot, generally designated 32, which receives the edge of the circuit board in the direction of arrow "A" (FIG. 4). Each slot has a first side 34 and a second side 36. First side 34 defines a fixed or rigid datum plane for engaging one side of the circuit board and, thereby, precisely locating the board. A flexible gripping arm 38 is molded integrally with each mounting post 30 at side 36 of slot 32 and extends generally parallel to insertion direction "A" as seen clearly in FIG. 4. The gripping arm has a projection 38*a* for engaging the side of the circuit board opposite the side of the board which engages datum plane 34. Flexible gripping arm 38 has a chamfered distal end 38*b* for engaging the edge of the board and, thereby, flex the gripping arm away from the board. When the board is fully inserted into slot 32, projection 38*a* engages the board and biases the board against datum plane 34 in the direction of arrow "B" (FIG. 4).

As best seen in FIGS. 2 and 3, a "fitting nail" 40 is fixed, as by a press-fit, into a slot 42 in the distal end of each mounting post 30. The fitting nails are fabricated of metal material and include flange portions 40*a* (FIG. 3) which are soldered to mounting pads on the circuit board to facilitate fixing the connector to the board.

Shield 20 of connector 10 includes a planar shielding plate 46 juxtaposed against front mating face 14 of housing 12, along with a shroud 48 which is drawn from the shielding plate to project forwardly of the plate 46 and surrounds the projecting mating portion 24 of the housing as best seen in FIG. 1. Plate 46 has a pair of holes 50 aligned with mounting holes 28 through the housing. A pair of top flanges 52 project rearwardly of the front plate and are seated in a pair of notches 54 of housing 12 as can be seen in FIGS. 2 and 3.

Figure 5:
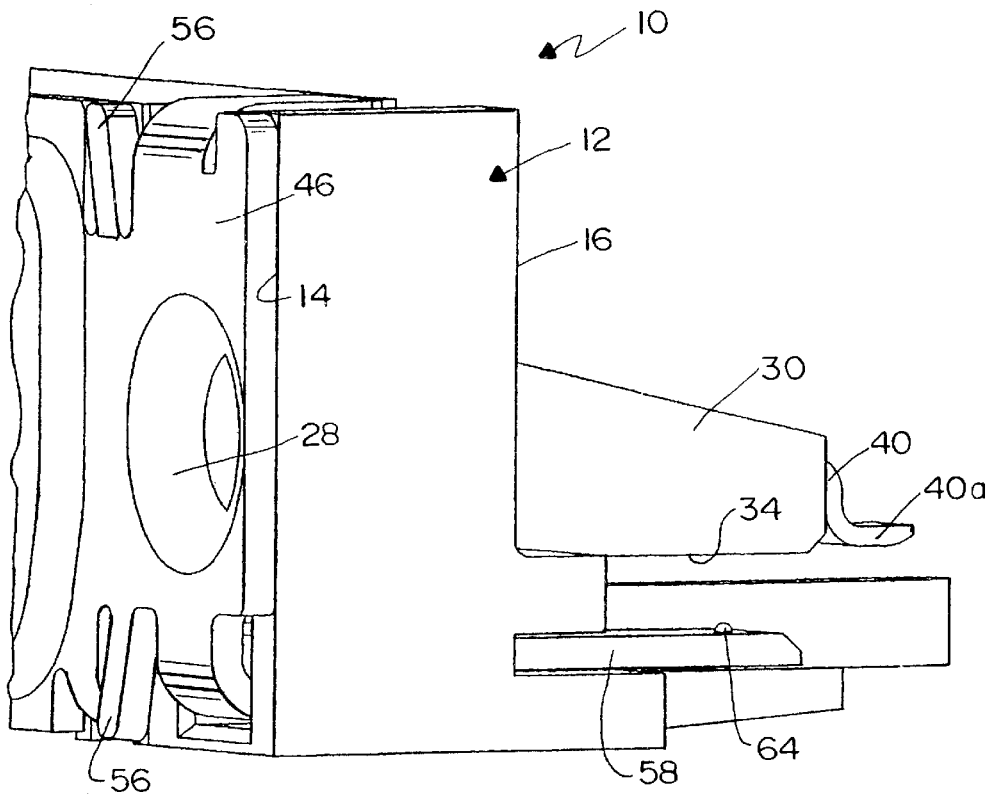
FIG. 5 is an enlarged perspective view of the right-hand end of the connector as viewed in FIG. 1, to better show two of the EMI tabs and one of the ground tabs of the connector shield.
Figure 6:
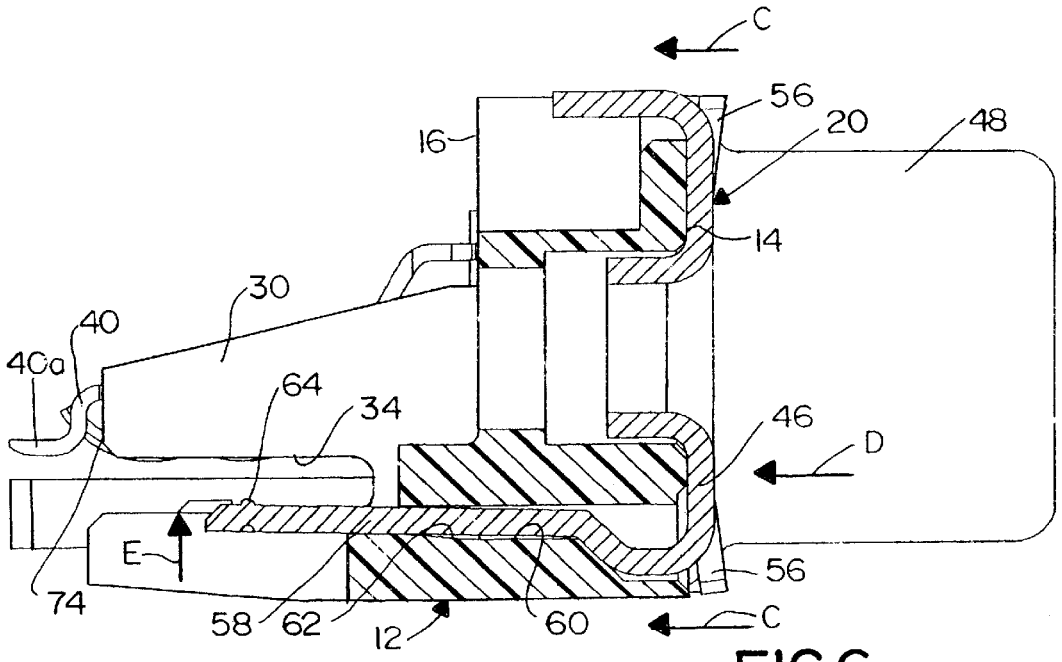
FIG. 6 is an enlarged vertical section taken generally along line 6—6 of FIG. 2.

A feature of shield 20 is to provide positive protection against electromagnetic interference (EMI) when the connector is mounted to a panel. The shield is stamped and formed of conductive sheet metal material. Referring to FIGS. 5 and 6 in conjunction with FIG. 1, four EMI tabs 56 are stamped out of plate 46 of shield 20 and are bent forwardly of the plate. Therefore when the connector is mounted with mating portion 24 of the housing and with shroud 48 of the shield projecting through an aperture in a panel, EMI tabs 56 will positively engage the panel. The tabs are resilient and will yield in the direction of arrows "C" (FIG. 6) when the connector is secured to the panel by appropriate fasteners extending through mounting holes 28 in the housing and 50 in the shield.

The shield also is grounded to appropriate grounding pads on the side of the circuit board which is engaged by gripping arms 38. Referring specifically to FIGS. 2, 3, 5 and 6, a pair of ground tabs 58 are integral with and project rearwardly of plate 46 of shield 20 through passages 60 (FIG. 6) of housing 12. The ground tabs project rearwardly of rear terminating face 16 of the housing adjacent to the bifurcated mounting post 30. Shield 20 is assembled to housing 12 in the direction of arrow "D" (FIG. 6). As ground tab 58 moves into passage 60, the distal end of the ground tab engages a ramp 62 at the bottom of the passage and biases the grounding tab upwardly in the direction of arrow "E". This accommodates any manufacturing tolerances which might space the ground tab from the grounding pad on the circuit board.

Ground tabs 68 also include means to prevent the ground tabs from wiping all of the solder paste off of the grounding pads on the circuit board. Specifically, each ground tab 58 has a small bump 64 punched therein which projects upwardly therefrom or in the direction of the circuit board. This bump is the portion of the ground tab that actually engages the solder coated grounding pad on the circuit board. With the bump being quite small, it wipes very little of the solder paste off of the grounding pad on the circuit board so that there is a good solder connection between the grounding pad and ground tab 58 of shield 20.

As stated above, terminals 18 (FIG. 2) are mounted through passages 22 in housing 12. Each terminal includes an enlarged or widened body portion 66 press-fit into the passages to fix the terminals in the housing. As seen in FIG. 1, the terminals have contact portions 68 projecting into silos 70 in mating portion 24 of the housing. The contact portions are shown as low force helix female contact portions for reception of an appropriate low force helix male terminal of a complementary mating connector.

Terminals 18 are mounted in three rows and have terminating portions projecting rearwardly of rear terminating face 16 of the housing as seen best in FIG. 2, for connection, as by soldering, to three rows of circuit pads on the circuit board, two rows being on one side of the board and one row being on the opposite side thereof. More particularly, as seen in FIG. 2, the top row of terminals have terminating portions 72 all in a row closer to rear face 16 of the housing than the terminating portions 74 of the middle row of terminals. Therefore, the top and middle rows of terminals engage (and are soldered to) two rows of circuit pads on one side of the circuit board. The bottom row of terminals have terminating portions 76 in a row for engaging circuit pads on the opposite side of the circuit board as the connector straddles the edge of the board.

Finally, although the features of the invention are not limited to the specific configuration of connector 10 shown and described herein, it should be explained that connector 10 is a combination ("combo") connector wherein terminals 18 primarily are signal terminals. In addition, four power terminals, generally designated 78, are provided with contact portions 80 projecting forwardly into mating portion 24 of the housing as seen in FIG. 1. Two power terminals 78 are disposed on each opposite side of a ground plate, generally designated 82 (FIG. 2) which has terminating legs 84 for connection, as by soldering, to grounding pads on opposite sides of the circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for straddle mounting at an edge of a circuit board having circuit traces on at least one side of the board near the edge, comprising:

a plurality of terminals mounted on the housing and including contact portions for connection to the circuit traces on the circuit board;

a flexible gripping arm integral with the housing at one side of said slot for yieldably engaging the circuit board upon insertion of the board into the slot; and a shield over at least a portion of said housing, the shield including a generally planar ground tab for connection to a grounding pad on the circuit board, the ground tab including a small protrusion for sliding over the grounding pad when the circuit board is inserted into said slot, the protrusion preventing the remainder of the ground tab from wiping solder paste off of the grounding pad on the circuit board.

2. The electrical connector of claim 1 wherein said housing defines a fixed datum plane at one side of the slot for locating the circuit board, and said flexible gripping arm is disposed at the opposite side of the slot for biasing the circuit board against the datum plane.

3. The electrical connector of claim 1 wherein said housing is molded of plastic material and the flexible gripping arm is molded integrally therewith.

4. The electrical connector of claim 1, including a plurality of said terminals mounted on the housing with contact portions for connection to circuit traces on both opposite sides of the circuit board.

5. The electrical connector of claim 1 wherein said housing is elongated with said terminals mounted thereon spaced from opposite ends of the housing, and including at least one of said gripping arms near each opposite end of the housing outside the terminals.

6. The electrical connector of claim 1 wherein said slot, flexible gripping arm and contact portions of the terminals are located at a rear terminating face of the housing, and including a shielding plate juxtaposed against a front mating face of the housing, the shielding plate including a plurality of integral, resilient EMI tabs projecting forwardly thereof for biasingly engaging a mounting panel to which the connector can be mounted.

7. The electrical connector of claim 6 wherein said shielding plate is stamped of sheet metal material, and said EMI tabs are bent forwardly thereof.

* * * * *